US007766581B2

(12) United States Patent
Munk et al.

(10) Patent No.: US 7,766,581 B2
(45) Date of Patent: Aug. 3, 2010

(54) SYSTEM, METHOD, AND APPARATUS FOR INDEPENDENT RETENTION OF A LOCKING DEVICE ON MOORING CONNECTIONS

(75) Inventors: Brian N. Munk, Houston, TX (US); Ed Mendoza, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 617 days.

(21) Appl. No.: 11/546,843

(22) Filed: Oct. 12, 2006

(65) Prior Publication Data

US 2008/0101872 A1 May 1, 2008

(51) Int. Cl.
*E02D 5/54* (2006.01)

(52) U.S. Cl. ..... 405/224.2; 405/224; 405/223.1; 166/338

(58) Field of Classification Search ..... 405/223.1, 405/224, 224.1, 224.2; 114/294, 230.1, 230.13; 166/338, 340, 354, 360
See application file for complete search history.

(56) References Cited

U.S. PATENT DOCUMENTS 5,020,942 A * 6/1991 Pallini, Jr. ..... 405/224
5,984,585 A 11/1999 Pallini, Jr. et al.

* cited by examiner

*Primary Examiner*—Tara Mayo-Pinnock
*Assistant Examiner*—Benjamin Fiorello
(74) *Attorney, Agent, or Firm*—Bracewell & Giuliani

(57) ABSTRACT

A tendon or riser connector has a separate lock-down device that overrides the connector's ability to unlock if the riser or tendon goes slack. The connector has a lock ring that engages a groove profile on a receptacle and is prevented from accidentally unlocking with a cam ring and set of blocks. The blocks are movably positioned between engaged and disengaged positions that correspond to the locked and unlocked positions of the lock ring.

27 Claims, 6 Drawing Sheets

SYSTEM, METHOD, AND APPARATUS FOR INDEPENDENT RETENTION OF A LOCKING DEVICE ON MOORING CONNECTIONS

BACKGROUND OF THE INVENTION

1. Technical Field

The present invention relates in general to tendon or riser mooring connectors and, in particular, to an improved system, method, and apparatus for enhancing the retention of tendon or riser moorings.

2. Description of the Related Art

In the prior art, one type of tendon or riser mooring connector for platforms typically operates with vertical motion only. At the sea floor, the connector is lowered a short distance into a receptacle mounted to the sea floor, lifted vertically, and locks into a profile in the receptacle. If lowered a longer distance into the receptacle, such as when the riser or tendon goes slack, an unlocking mechanism allows the connector to release from the receptacle. Under extreme environmental operating conditions, such as hurricanes, the connector can be accidentally unlocked due to motion of the platform at the surface and severely jeopardize the safety of personnel and equipment. Thus, an improved solution for enhancing a secure connection between tendon or riser moorings and receptacles would be desirable.

SUMMARY OF THE INVENTION

One embodiment of a system, method, and apparatus for locking down a tendon or riser mooring incorporates a separate lock-down device that overrides the connector's ability to unlock if the riser or tendon goes slack. The locking device engages a groove profile on a receptacle and is prevented from accidentally unlocking with securing means located between the locking device and the connector. The securing means is movably positioned (e.g., rotationally or axially) between engaged and disengaged positions that correspond to the locked and unlocked positions of the lock device.

In one embodiment, the lock device is a lock ring that is biased radially outward into engagement with the groove profile. The securing means may utilize a cam ring that is actuated by a diver, a remotely-operated vehicle (ROV), or a hydraulic or mechanical drive mechanism. The cam ring moves a set of blocks to selectively engage the lock ring with slots, weldments, levers, and the like.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
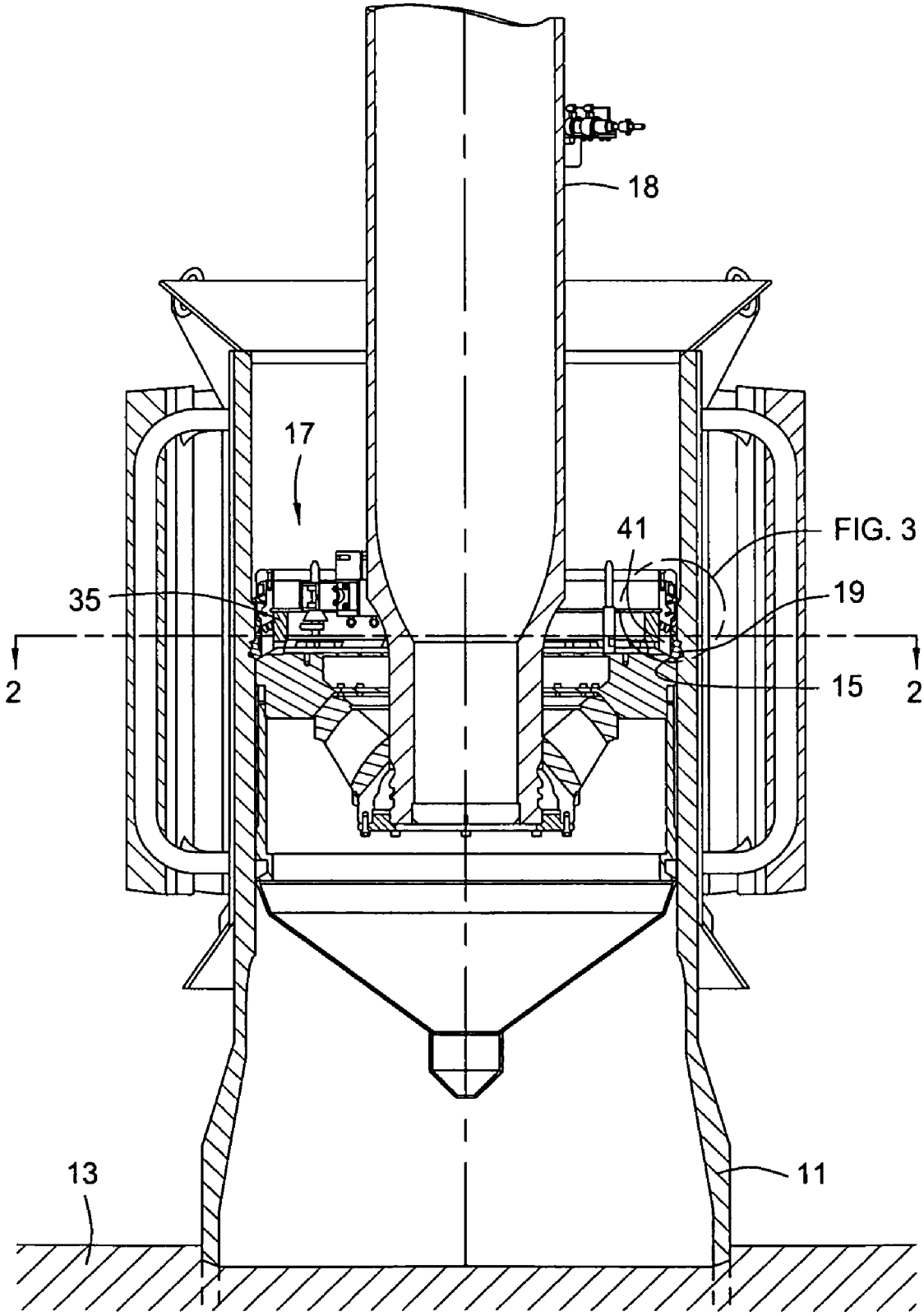
FIG. 1 is a sectional side view of one embodiment of a bottom mooring constructed in accordance with the present invention.
Figure 2:
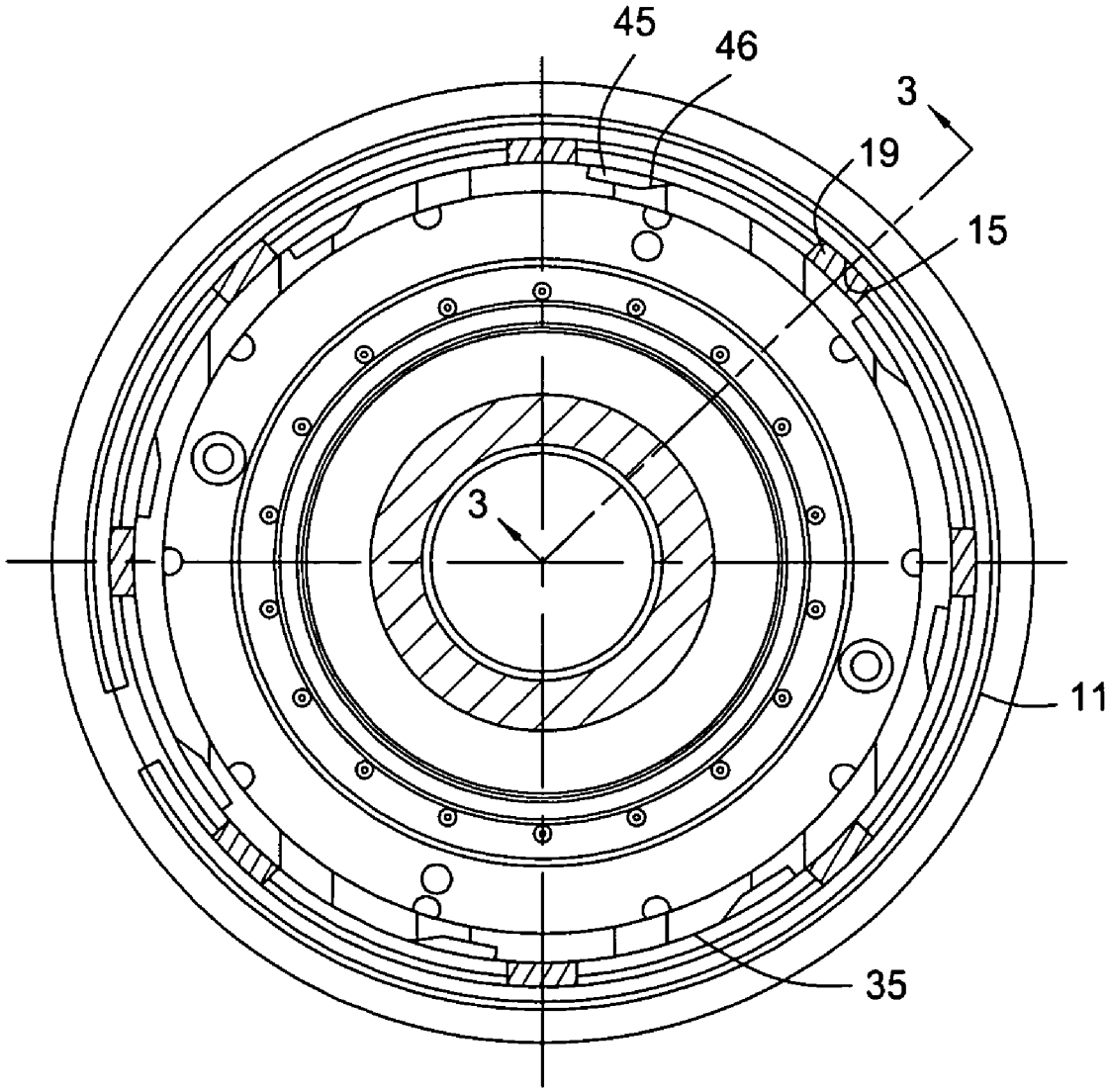
FIG. 2 is a sectional top view of a connector in the bottom mooring of FIG. 1 in a locked position, taken along the line 2-2 of FIG. 1 and is constructed in accordance with the present invention.

Referring to FIGS. 1-5, one embodiment of a system, method, and apparatus for securing a mooring connection is disclosed. One skilled in the art will recognize that the invention also is suitable for other applications including squnch connectors, handling tools, etc. A mooring receptacle 11 is located on the sea floor 13.

A bottom connector 17 has a tubular member 18 (e.g., a tendon or riser) extending therefrom to a platform at a sea surface (not shown). Alternatively, the bottom connector 17 may comprise a squnch connector, a handling tool, etc. The bottom connector 17 is secured to an interior groove profile 15 in the receptacle 11 with a lock device 19 (e.g., lock ring, lock dogs, etc.) that is horizontally movable relative to the groove profile 15. The lock device 19 may be biased radially outward into engagement with the groove profile 15, or it may be neutrally biased or biased radially inward.

In the embodiment shown, the bottom connector 17 may be connected to and disconnected from the receptacle 11 strictly via vertical motion. In this way, the bottom connector 17 locks into the receptacle 11 by being lowered into the receptacle for a limited distance, past a locked position, but not enough to engage an unlocked position, and then raised back up to the locked position. The bottom connector 17 is unlocked from the receptacle 11 by being lowered beyond the locked position to the unlocked position, after which the bottom connector 17 may be removed from the receptacle 11 by upward vertical motion. An optional sleeve (e.g., anode sleeve) may be lowered onto and secured to an exterior of the receptacle 11 to provide cathodic protection for the installation.

The invention also comprises securing means 21 for preventing the lock ring 19 from disengaging the groove profile 15 so that the bottom connector 17 cannot be further lowered to the unlocked position and, thus, accidentally unlocked from the receptacle 11. In one embodiment, the securing means 21 is integrated with the bottom connector 17 and is adjacent the lock device 19.

In one embodiment, a lockdown mechanism or the securing means 21 (see, e.g., FIG. 5) has an engaged position that restrains the lock device 19 from disengaging the groove profile 15 via horizontal motion relative to the receptacle 11, and a disengaged position that permits the lock device 19 to disengage the groove profile 15 via horizontal motion of the lock device 19 relative to the receptacle 11. As will be recognized by those skilled in the art, the securing means 21 may be actuated by a diver, a remotely-operated vehicle (ROV), and a hydraulic drive mechanism.

Figure 3:
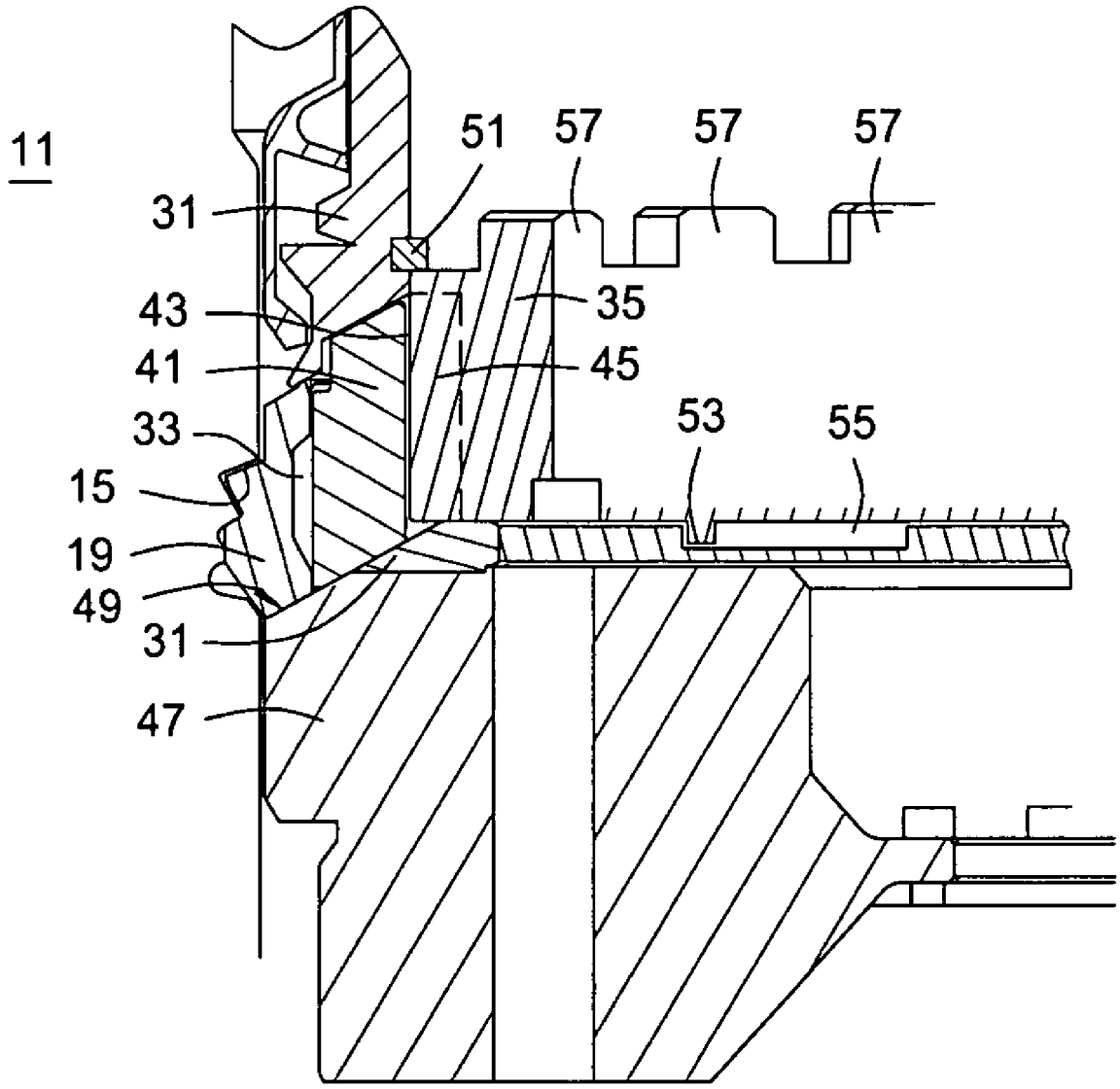
FIG. 3 is an enlarged sectional side view of the connector of FIG. 2 taken along the line 3-3 of FIG. 2 and is constructed in accordance with the present invention.
Figure 4:
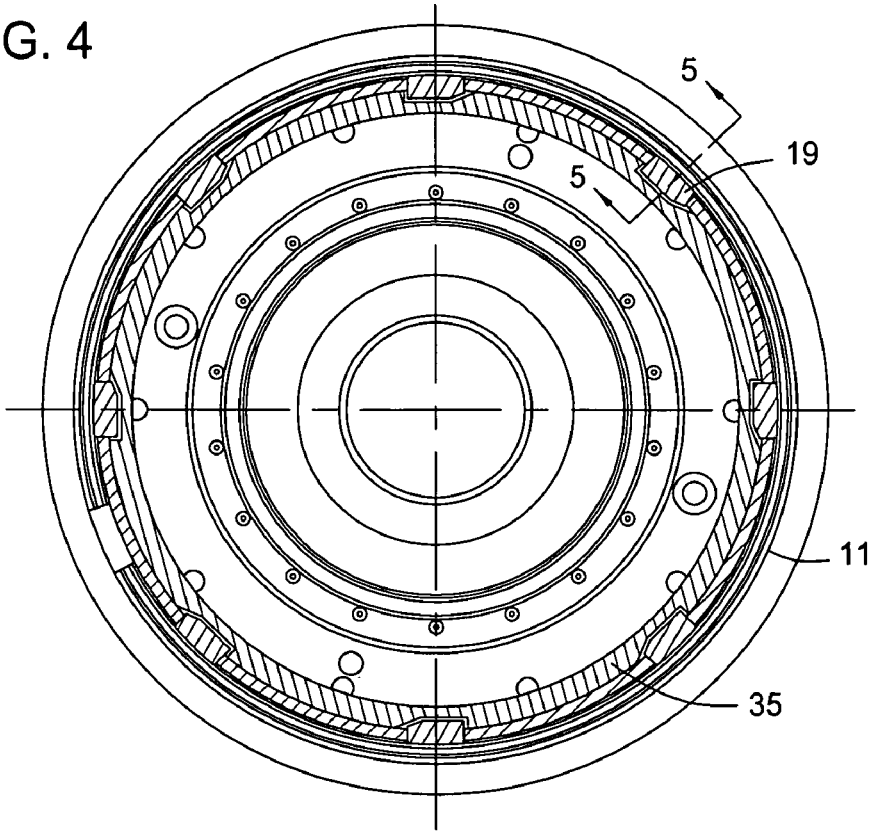
FIG. 4 is a sectional top view of the connector of FIG. 2 in an unlocked position and is constructed in accordance with the present invention.
Figure 5:
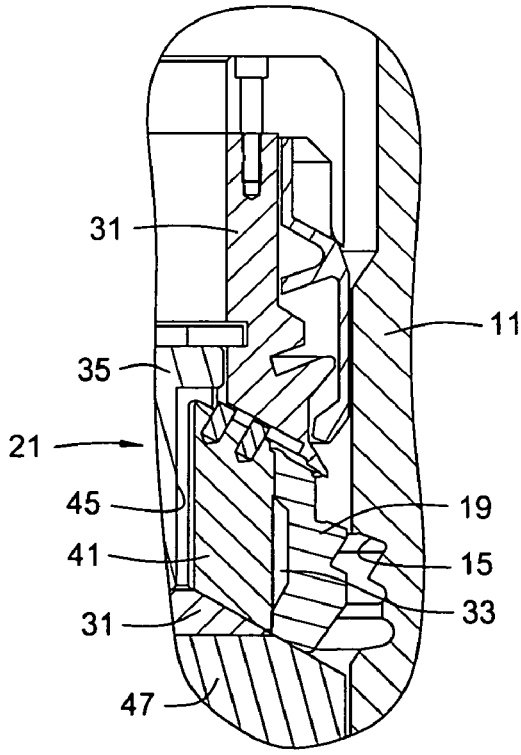
FIG. 5 is an enlarged sectional side view of the connector of FIG. 4 taken along the line 5-5 of FIG. 4 and is constructed in accordance with the present invention.

In some of the embodiments of the present invention, the connector 17 and securing means 21 utilize an upper body 31 (FIG. 3). The upper body 31 may comprise a cavity 33 that contains the lock device 19. A cam ring 35 is located in the upper body 31 adjacent the cavity 33. The cam ring 35 is movable (e.g., rotatable about a central axis or axially movable) relative to the lock device 19 between a locked position (FIGS. 1-3) and an unlocked position (FIGS. 4 and 5).

The securing means 21 also comprises a set of blocks 41 (e.g., 6 to 8) located in the upper body cavity 33 between the cam ring 35 and the lock device 19. The blocks 41 have an engaged position (FIGS. 1-3) that prevents the lock device 19 from disengaging the groove profile 15. The blocks 41 also have a disengaged position (FIGS. 4 and 5) that permits the lock device 19 to disengage the groove profile 15. The blocks 41 are movable (e.g., radially or axially) between the engaged and disengaged positions as the cam ring 35 is moved between the locked and unlocked positions, respectively, such that the cam ring 35 moves relative to the blocks 41 and the lock device 19.

In the embodiment of FIGS. 1-5, the cam ring 35 has a perimeter 43 and slots 45 formed in the perimeter 43. The blocks 41 move between the engaged and disengaged positions by movement out of and into the cam ring slots 45 as the cam ring 35 is rotated between the locked and unlocked positions, respectively. The cam ring 35 and the blocks 41 have a loose fit with radial gaps therebetween in the locked and engaged positions, respectively. Alternatively, the cam ring 35 and blocks 41 may remain in contact with no gaps therebetween such that forces are immediately transmitted. The blocks 41 may be secured to the lock device 19 such that the lock device 19 is required to move with the blocks 41 as the blocks 41 are moved between the engaged and disengaged positions.

As illustrated in FIGS. 1-5, the connector 17 and securing means 21 may utilize a lower body 47 that is located below the upper body 31, both of which have a sloped surface 49. The lock device 19 and the blocks 41 have lower ends that are mutually supported on the sloped surface 49. The cam ring slots 45 are rectangular with inclined surfaces 46 (FIG. 2) for facilitating radially outward motion of the blocks 41 from the disengaged position to the engaged position.

In some embodiments, the cam ring 35 is retained in the upper body 31 with a restraining ring 51. In addition, the cam ring 35 has a key or lug 53 formed on a lower portion thereof that moves in a slot 55 formed in the upper body 31 for limiting rotational motion of the cam ring 35 between the locked and unlocked positions. Furthermore, in one embodiment the cam ring 35 has crenelations 57 formed on an upper portion thereof for facilitating rotational motion of the cam ring 35 via an external influence (e.g., diver, a remotely-operated vehicle (ROV), a hydraulic or mechanical drive mechanism, etc.), such as those known in the art.

Figure 6:
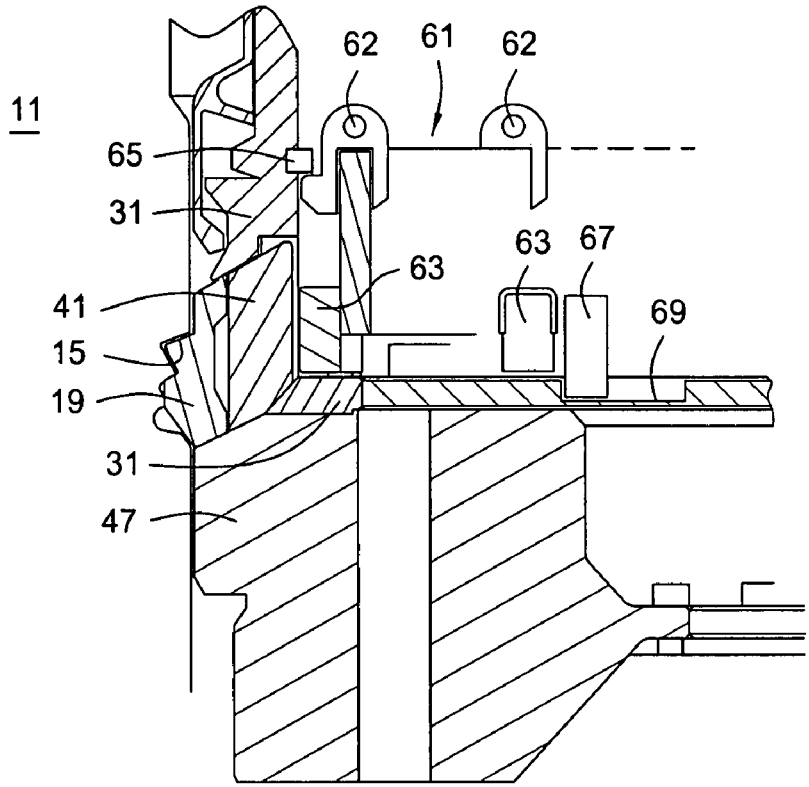
FIG. 6 is a sectional side view of a second embodiment of a bottom mooring connector constructed in accordance with the present invention.

Referring now to FIG. 6, another embodiment of the securing means is shown. In this embodiment, the cam ring comprises a cam weldment 61 having a set of weld blocks 63 on a lower portion thereof. The weld blocks 63 are complementary to the blocks 41 for retaining the blocks 41 in the engaged position when the cam weldment 61 is in the locked position, and for allowing the blocks 41 to move to the disengaged position when the cam weldment 61 is in the unlocked position. Other features of this embodiment of the invention are similar or identical to those described above.

The cam weldment 61 is retained in the upper body 31 with a restraining ring 65. The cam weldment 61 has a key or lug 67 formed on a lower portion thereof that moves in a slot 69 formed in the upper body 31 for limiting rotational motion of the cam weldment 61 between the locked and unlocked positions. In one embodiment, the cam weldment 61 has pad eyes 62 formed on an upper portion thereof for facilitating rotational motion of the cam weldment 61 via an external influence.

Figure 7:
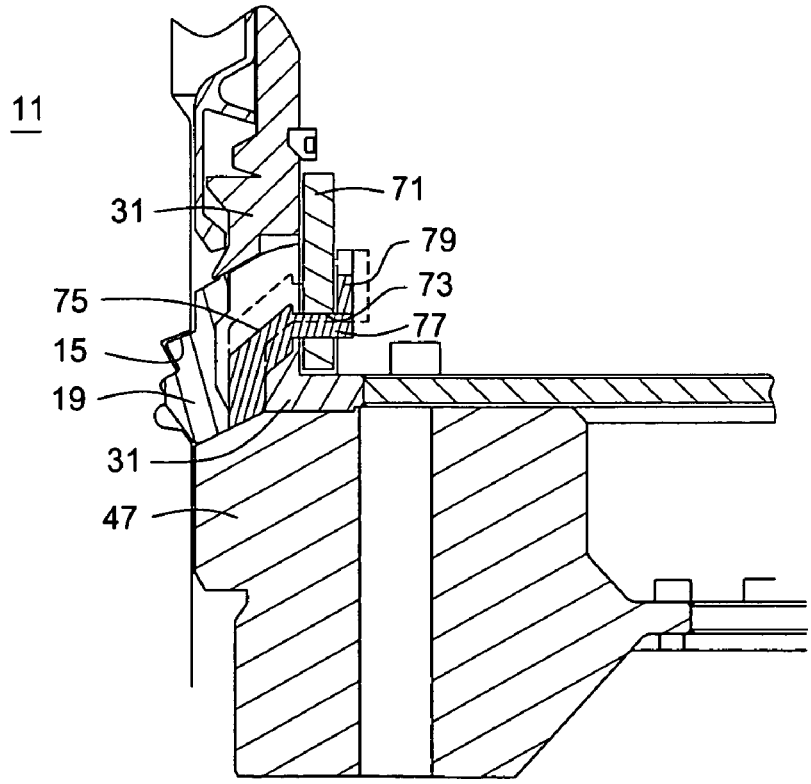
FIG. 7 is a sectional side view of a third embodiment of a bottom mooring connector constructed in accordance with the present invention.
Figure 8:
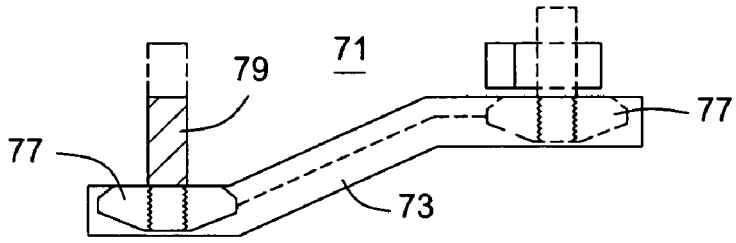
FIG. 8 is a front view of a portion of a securing mechanism of the connector of FIG. 7 constructed in accordance with the present invention.

Referring now to FIGS. 7 and 8, another embodiment of the cam ring 71 has drive slots 73. In this version, each block comprises a block body 75, an arm 77 extending from the block body 75 through a respective one of the drive slots 73, and a pin 79 extending from the arm 77 located opposite the block body 75 for retaining the block on the cam ring 71. The block body 75 is located between the lock device 19 and the upper body 31 in the locked position (i.e., solid lines in FIGS. 7 and 8), and the block body 75 is removed from between the lock device 19 and the upper body 31 in the unlocked position (see dashed lines in FIGS. 7 and 8) to permit the lock device 19 to move from the engaged position to the disengaged position, respectively.

Figure 9:
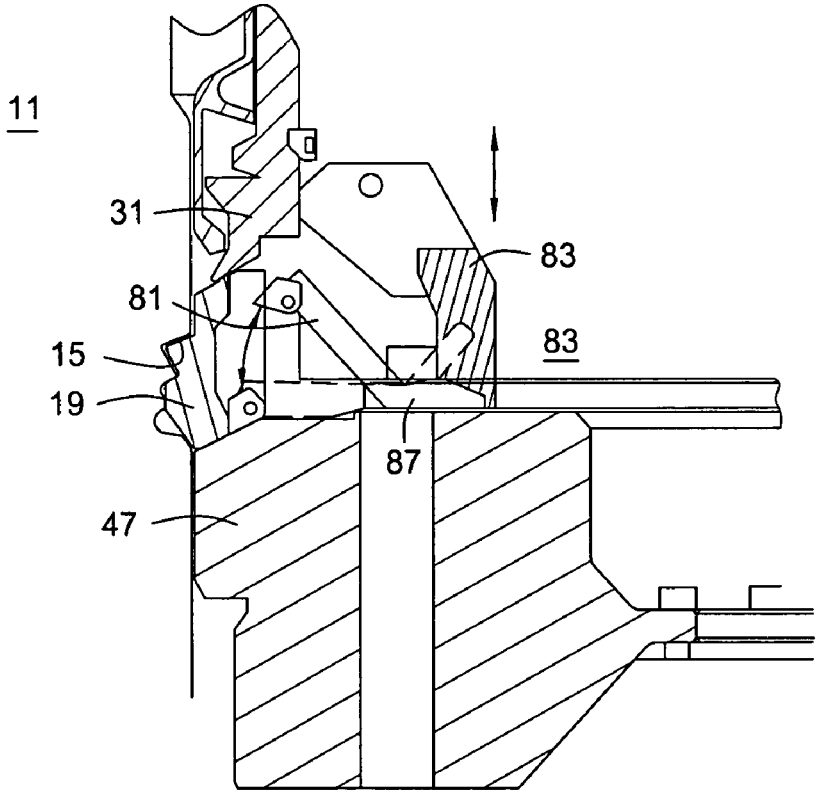
FIG. 9 is a sectional side view of a fourth embodiment of a bottom mooring connector constructed in accordance with the present invention.
Figure 10:
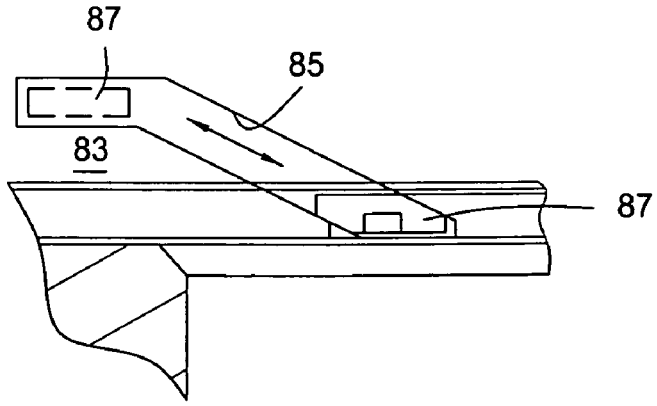
FIG. 10 is a front view of a portion of a securing mechanism of the connector of FIG. 9 constructed in accordance with the present invention.

FIGS. 9 and 10 depict an alternate embodiment wherein the blocks comprise lever arms 81 mounted to the lower body 47. The lever arms 81 are pivotably movable between engaged (see dashed lines) and disengaged positions as the cam ring 83 is moved between the locked and unlocked positions, respectively. The cam ring 81 may moved between the locked and unlocked positions via rotational movement (FIG. 10) where an end 87 of lever arms 81 move in a slot 85, and vertical axial motion (FIG. 9). In the engaged positions, the lever arms 81 abut the lock device 19 to prevent the lock device 19 from unlocking and, in the disengaged positions, the lever arms 81 are pivoted away from the lock device 19 to permit the lock device 19 to unlock.

While the invention has been shown or described in only some of its forms, it should be apparent to those skilled in the art that it is not so limited, but is susceptible to various changes without departing from the scope of the invention.

What is claimed is:

1. A subsea connector assembly comprising:

a receptacle having a groove profile;

a connector having a tubular member extending therefrom;

a lock device on the connector, the lock device being a lock ring that is expansible into a locked position in engagement with the groove profile in the receptacle;

securing means for preventing the lock device from disengaging from the groove profile, the securing means including a cam ring and a block member and being integrated with the bottom connector, wherein rotating the cam ring in one direction moves the block member into restraining engagement with the lock device to prevent the lock device from disengaging the groove profile, and rotating the cam ring in an opposite direction releases the block member from restraining engagement with the lock device to permits the lock device to disengage the groove profile; and wherein moving the block member into restraining engagement with the lock device occurs after the lock device is in the locked position.

2. A system according to claim 1, wherein:

the securing means prevents the lock device from radially contracting while the block member is in restraining engagement with the lock device.

3. A system according to claim 1, wherein the lock device is biased radially outward into engagement with the groove profile.

4. A system according to claim 1, wherein the tubular member of the bottom connector is one of a tendon and a riser.

5. A system according to claim 1, wherein the cam ring is rotated by a device selected from the group consisting of a diver, a remotely-operated vehicle (ROV), a mechanical drive mechanism, and a hydraulic drive mechanism.

6. A system according to claim 1, wherein the securing means comprises:

an upper body having a cavity containing the lock device;

the cam ring being located in the upper body adjacent the cavity, and the cam ring being movable relative to the lock device between locked and unlocked positions; and the block member comprises blocks located in the upper body cavity between the cam ring and the lock device, the blocks being movable between engaged and disengaged positions with the lock device as the cam ring is moved between the locked and unlocked positions, respectively.

7. A system according to claim 6, wherein the cam ring has a perimeter and slots formed in the perimeter, and the blocks move between the engaged and disengaged positions by movement out of and into the cam ring slots as the cam ring is rotated between the locked and unlocked positions, respectively.

8. A system according to claim 7, wherein the blocks are in the engaged position while in contact with the perimeter of the cam ring between the slots, and in the disengaged position while positioned in the slots.

9. A system according to claim 6, wherein:

the blocks arc located between the lock ring and the cam ring; and the cam ring has cam surfaces that engage the blocks and force the blocks radially outward against the lock ring when the cam ring is rotated from the unlocked position to the locked position.

10. A system according to claim 6, further comprising:

a lower body located below the upper body and having a sloped surface, the lock device and the blocks having lower ends that are mutually supported on the sloped surface; and the cam ring has rectangular slots r with inclined surfaces for receiving the blocks therein while in the disengaged position.

11. A system according to claim 6, wherein the cam ring is retained in the upper body with a restraining ring, the cam ring has a key formed on a lower portion thereof that moves in a slot formed in the upper body for limiting rotational motion of the cam ring between the locked and unlocked positions, and the cam ring has a drive profile formed thereon for facilitating rotational motion of the cam ring via an external influence.

12. A system according to claim 6, wherein the cam ring comprises a cam weldment having a set of weld blocks on a lower portion thereof, the set of weld blocks being complementary to the blocks for retaining the blocks in the engaged position when the cam weldment is in the locked position, and for allowing the blocks to move to the disengaged position when the cam weldment is in the unlocked position; and further comprising a lower body located below the upper body and having a sloped surface, the lock device and the blocks having lower ends that are mutually supported on the sloped surface, and the weld blocks being rectangular with inclined surfaces for facilitating radially outward motion of the blocks from the disengaged position to the engaged position.

13. A system according to claim 12, wherein the cam weldment is retained in the upper body with a restraining ring, the cam weldment has a button formed on a lower portion thereof that moves in a slot formed in the upper body for limiting rotational motion of the cam weldment between the locked and unlocked positions, and the cam weldment has pad eyes formed on an upper portion thereof for facilitating rotational motion of the cam weldment via an external influence.

14. A system according to claim 6, wherein the cam ring has drive slots, and each block comprises a block body, an arm extending from the block body through a respective one of the drive slots, and a pin extending from the arm located opposite the block body for retaining the block on the cam ring, such that the block body is located between the lock device and the upper body in the engaged position, and the block body is removed from between the lock device and the upper body in the unlocked position to permit the lock device to move from the engaged position to the disengaged position.

15. A system according to claim 6, wherein the blocks comprise lever arms, the lever arms being pivotably movable between engaged and disengaged positions as the cam ring is moved between the locked and unlocked positions, respectively; wherein the cam ring is moved between the locked and unlocked positions via one of rotational movement and vertical axial motion; and wherein in the engaged positions, the lever arms abut the lock device to prevent the lock device from unlocking and, in the disengaged positions, the lever arms are pivoted away from the lock device to permit the lock device to unlock.

16. A system for securing a mooring connection, comprising:

a receptacle for location on a sea floor and having a groove profile;

a bottom connector for connection to a tubular member extending therefrom to a platform at a sea surface, the bottom connector being secured to the groove profile in the receptacle via a lock device being a split ring that is radially expansible into engagement with the groove profile;

a cam ring adjacent to the lock device, and the cam ring being rotatable relative to the lock device between locked and unlocked positions; and blocks located between the cam ring and the lock device, the blocks having an engaged position in contact with the lock device that prevents the lock device from disengaging the groove profile, and a disengaged position spaced from the lock device that permits the lock device to disengage the groove profile, the blocks being radially movable between the engaged and disengaged positions in response to rotation of the cam ring moved between the locked and unlocked positions, respectively.

17. A system according to claim 16, wherein the lock device is biased radially outward into engagement with the groove profile.

18. A system according to claim 16, wherein the cam ring is rotatable by a remotely-operated vehicle (ROV).

19. A system according to claim 16, wherein the cam ring has a perimeter and slots formed in the perimeter, and the blocks move between the engaged and disengaged positions by movement out of and into the cam ring slots as the cam ring is rotated between the locked and unlocked positions, respectively.

20. A system according to claim 19, wherein the blocks are located between the slots while in the engaged position.

21. A system according to claim 16, further comprising a lower body located below the upper body and having a sloped surface, the lock device and the blocks having lower ends that are mutually supported on the sloped surface, and the cam ring has rectangular slots with inclined surfaces for receiving the blocks while in the disengaged position.

22. A system according to claim 16, wherein the cam ring is retained in the upper body with a restraining ring, the cam ring has a key formed on a lower portion thereof that moves in a slot formed in the upper body for limiting rotational motion of the cam ring between the locked and unlocked positions, and the cam ring has a drive profile formed on an upper portion thereof for facilitating rotational motion of the cam ring via an external influence.

23. A system according to claim 16, wherein the cam ring comprises a cam weldment having a set of weld blocks on a lower portion thereof, the set of weld blocks being complementary to the blocks for retaining the blocks in the engaged position when the cam weldment is in the locked position, and for allowing the blocks to move to the disengaged position when the cam weldment is in the unlocked position; and further comprising a lower body located below the upper body and having a sloped surface, the lock device and the blocks having lower ends that are mutually supported on the sloped surface, and the weld blocks being rectangular with inclined surfaces for facilitating radially outward motion of the blocks from the disengaged position to the engaged position.

24. A system according to claim 23, wherein the cam weldment is retained in the upper body with a restraining ring, the cam weldment has a button formed on a lower portion thereof that moves in a slot formed in the upper body for limiting rotational motion of the cam weldment between the locked and unlocked positions, and the cam weldment has pad eyes formed on an upper portion thereof for facilitating rotational motion of the cam weldment via an external influence.

25. A system according to claim 16, wherein the cam ring has drive slots, and each block comprises a block body, an arm extending from the block body through a respective one of the drive slots, and a pin extending from the arm located opposite the block body for retaining the block on the cam ring, such that the block body is located between the lock device and the upper body in the engaged position, and the block body is removed from between the lock device and the upper body in the unlocked position to permit the lock device to move from the engaged position to the disengaged position.

26. A system according to claim 16, wherein the blocks comprise lever arms mounted to the lower body, the lever arms being pivotably movable between engaged and disengaged positions as the cam ring is moved between the locked and unlocked positions, respectively; wherein the cam ring is moved between the locked and unlocked positions via one of rotational movement and vertical axial motion; and wherein in the engaged positions, the lever arms abut the lock device to prevent the lock device from unlocking and, in the disengaged positions, the lever arms are pivoted away from the lock device to permit the lock device to unlock.

27. A system for securing a mooring connection, comprising:

a receptacle for location on a sea floor and having a groove profile;

a bottom connector having a tubular member extending therefrom for connection to a platform at a sea surface;

a lock device comprising a lock ring carried by the bottom connector, the lock device being radially expansible into engagement with the groove profile;

a cam ring located extending around the lock device, the cam ring having an inner diameter containing a plurality of spaced apart slots, each of the slots being separated by a cam surface;

a plurality of blocks located between the cam ring and the lock device and within an inner diameter of the lock device, the blocks having an engaged position wedged between the cam surfaces and the lock device that prevents the lock device from contracting radially and disengaging the groove profile, the blocks having a disengaged position located within the slots, which permits the lock device to contract radially and disengage the groove profile; wherein the cam ring is rotatable relative to the lock device and the blocks between a locked position wherein the blocks are in engagement with the cam surfaces, and an unlocked position; and the blocks are located within the slots.

* * * * *